US005852280A

United States Patent [19]

Mizuno

[11] Patent Number: 5,852,280

[45] Date of Patent: Dec. 22, 1998

[54] CERAMIC HEATER

[75] Inventor: Takanori Mizuno, Seto, Japan

[73] Assignee: NGK Spark Plug Co., Ltd., Nagoya, Japan

[21] Appl. No.: 45,677

[22] Filed: Mar. 23, 1998

[30] Foreign Application Priority Data

Mar. 31, 1997 [JP] Japan ..... 9-079517
Mar. 3, 1998 [JP] Japan ..... 10-050380

[51] Int. Cl.[6] ..... F23Q 7/00

[52] U.S. Cl. ..... 219/270; 219/544; 123/145 A

[58] Field of Search ..... 219/270, 544, 219/546; 123/145 A; 361/264–266

[56] References Cited

FOREIGN PATENT DOCUMENTS 63-50606 12/1988 Japan .

2-43091 9/1990 Japan .

*Primary Examiner*—Teresa J. Walberg
*Assistant Examiner*—Vino D. Patel
*Attorney, Agent, or Firm*—Morgan, Lewis & Bockius LLP

[57] ABSTRACT

A ceramic sintered body fitted into an inner hole through a cylindrical metal outer pipe in the state in which the front end side of the ceramic sintered body is protruded out from the front end of an metal shell, includes: a heating portion to which a positive-pole-side lead is connected in the front end side; and a positive-pole-side electrode lead-out portion having a positive-pole-side electrode portion which is extendedly provided from the positive-pole-side lead in the rear end side. Further, the outer diameter of the positive-pole-side electrode lead-out portion is set to be smaller than that of the negative-pole-side electrode lead-out portion so that the positive-pole-side lead is substantially linear and a sufficient insulation distance between the metal shell functioning as a negative-pole-side terminal and the positive-pole-side lead coil can be secured.

12 Claims, 6 Drawing Sheets

CERAMIC HEATER

BACKGROUND OF THE INVENTION

1. Field of the Invention

The present invention relates to a ceramic heater for igniting fuel and particularly relates to a ceramic glow plug for assisting the start of a Diesel engine.

2. Description of the Conventional Art

In a Diesel engine mounted on a car, ignition (engine start) is apt to be difficult particularly in a cold season because fuel is ignited by heat generated when air is compressed. Heretofore, a pre-heater is provided to assist this ignition. The pre-heater is constituted by a glow plug, a glow plug controller, a glow plug relay, etc.

The general structure of a ceramic glow plug attached to an antechamber such as a precombustion chamber, a vortex chamber, or the like, in the Diesel engine will be described below. For example, as shown in FIGS. 8 and 9, a ceramic glow plug (first conventional art) comprises a main metal shell 101 for attaching the ceramic glow plug to the Diesel engine, and a ceramic sintered body 104 fitted into an inner hole 102 of the main metal shell 101 and including a heating element 103 embedded in the front end side. Further, a lead 105 is connected to one end of the heating element 103 and a lead 106 is connected to the other end thereof. A ceramic sintered body material is sintered by hot press and thereafter, is carried out a grinding process and the like so that the lead 105 is connected to the electrode portion 107 exposed to the outer periphery of the ceramic sintered body 104. The electrode portion 107 is connected to a lead coil 108. On the other hand, the lead 106 is similarly connected to an electrode portion 109 exposed to the outer periphery of the ceramic sintered body 104. The ceramic sinter body 104 is glass-bonded and then brazed to the metal outer pipe 112 and loosely fitted and brazed to the main metal shell 101 so that the electrode portion 109 is connected to the metal outer pipe 112.

As another conventional technique, there is a ceramic glow plug (second conventional art) in which, as shown in FIG. 10, the electrode portions 107, 109 are connected to the lead coils 108, 110, respectively. As a further conventional technique, there is a ceramic glow plug (third conventional art) in which, as shown in FIG. 11, a conductive cap 111 is used in place of the lead coil 108.

In the ceramic glow plug of the first to third conventional art techniques, the outer diameter of the intermediate portion fitted to the inner hole 102 of the main metal shell is equal to the outer diameter of the electrode lead-out portion in the rear end side of the ceramic sintered body 104. Accordingly, it is necessary to place the electrode portions 107, 109 in the same diameter size position by bending the leads 105, 106. Further, if the lead coils 108, 110 and the cap 111 are assembled to the electrode lead-out portion, the outer diameter of parts received in the inner hole 102 of the main metal shell 101 becomes larger than that of the electrode lead-out portion.

Therefore, conventionally, it is necessary that the bending shape should be strictly controlled in size and the position of the leads 105, 106 in the ceramic sintered body is strictly controlled in order to place the electrode portions 107, 109 in the same diameter size position by bending the leads 105, 106. Further, in order to secure the inner diameter P of the inner wall surface of the inner hole 102 of the main metal shell 101, the coil outer diameter Q of the lead coil 108 and the diameter difference (gap for electrical insulation), a relief portion 112 is provided in the inner hole 102. Accordingly, there is a disadvantage that the main metal shell 101 is inevitably large in size. There is a further disadvantage that if the main metal shell is made small, the gap for electrical insulation can not be secured or the thickness of the main metal shell should be thinner, thereby the strength being lowered. Specifically, it is impossible to produce the main metal shell 101 having an attachment screw diameter smaller than M10.

Further, because the ceramic sintered body 104 and the metal outer pipe 113 are glass-bonded and then brazed to each other and the metal outer pipe 113 and the main metal shell 101 are brazed to each other, eccentricity is apt to occur and it is difficult to secure the clearance between the inner hole 102 of the main metal shell 101 and the lead coil 108 or the cap 111. In this case, it may be thought of to reduce the outer diameter of the ceramic sintered body. It is, however, necessary to secure the diameter which can bear the impact of combustion because the heating portion of the ceramic sintered body is attached to the precombustion chamber or combustion chamber so as to be exposed therein. It is further necessary to obtain the diameter which is sufficient to secure heat capacity in order to stabilize combustion. Hence, the outer diameter of the ceramic sintered body cannot be reduced so much.

Therefore, there has been proposed a ceramic glow plug (fourth conventional art, technique described in Examined Japanese Patent Publication No. Hei-2-43091) in which the outer diameter of the electrode lead-out portion in the rear end side of the ceramic sintered body is made smaller than the outer diameter of the heating portion in the front end side of the ceramic sintered body. If the outer diameter of the electrode lead-out portion is made simply smaller than the outer diameter of the heating portion, there, however, arises a disadvantage that the strength of the electrode lead-out portion of the ceramic sintered body is lowered. Because the electrode lead-out portion is present in the inside of the main metal shell 101 of the ceramic glow plug, the strength of the electrode lead-out portion is not required to be so large in comparison with the heating portion of the ceramic sintered body 104. However, because the electrode lead-out portion is connected to an external on-vehicle electric source while the electrode lead-out portion is kept electrically insulated from the main metal shell 101 through the positive-pole-side lead coil 107 or the electric conductive cap 110, the strength of the electrode lead-out portion which can bear vibration both at the time of assembling of the ceramic glow plug and at the time of use thereof in the engine is required.

It may be further thought of to make the outer diameter of the electrode lead-out portion equal to the outer diameter of the heating portion to keep the strength of the electrode lead-out portion of the ceramic sintered body and to make the coil diameter of the lead coil 108 very small instead. In this case, because the resistance of the lead coil 108 arises so that the lead coil 108 is heated by applying current, there arises a disadvantage that the durability of the lead coil 108 is lowered so that stable current conduction cannot be obtained.

Further, in the ceramic glow plug according to the fourth conventional art technique, cutting is performed to make the outer diameter of the electrode lead-out portion smaller than the outer diameter of the heating portion. If the outer diameter of the electrode lead-out portion is extremely larger than the coil inner diameter of the lead coil 108 because of production error, there arises a disadvantage that the lead coil 108 cannot be assembled with the ceramic sintered body. If the outer diameter of the electrode lead-out portion is contrariwise extremely smaller than the coil inner diameter of the lead coil 108 because of production error, there arises a disadvantage that the lead coil 108 comes off from the ceramic sintered body.

SUMMARY OF THE INVENTION

An object of the present invention is to provide a ceramic heater capable of easily controlling the shape and the position of the lead arranged in the inside of the ceramic sintered body. Another object of the present invention is to provide a ceramic heater in which the strength of a ceramic sintered body is prevented from being lowered and the durability of an electric conductive member is prevented from being lowered so that stable current conduction can be obtained. Another object of the present invention is to provide a ceramic heater in which a lead coil and the electric conductive member are assembled with the ceramic sintered body easily. A further object of the present invention is to provide a ceramic heater in which the electric conductive member is prevented from coming off from the ceramic sintered body so that stable current conduction can be obtained.

First aspect to the present invention is a ceramic heater comprising: a main metal shell having an inner hole in an axial direction; a ceramic sintered body in which an intermediate portion is fitted into the inner hole and a front end portion is protruded out from the main metal shell, the ceramic sintered body having a heating portion provided with a heating element embedded in the front end side, a small-diameter portion provided in the rear end side and having a smaller outer diameter than the outer diameter of the heating portion, a first electrode electrically connected to one end portion of the heating portion and bent to expose to the outer periphery itself, and a second electrode electrically connected to the other end portion of the heating portion and bent to expose to the outer periphery of the small-diameter portion, the bending of the second electrode being smaller than that of the first electrode; and an electric conductive portion electrically connected to the second electrode exposed to the outer periphery of the small-diameter portion of the ceramic sintered body.

Second aspect of the present invention is a ceramic heater according to the first aspect, wherein the second electrode is substantially linear.

Third aspect of the present invention is a ceramic heater according to the first and the second aspect of the present invention, satisfying the following relations:

$$\phi 3.3\ \text{mm} \leqq Y$$

$$\phi 2.5\ \text{mm} \leqq Z$$

where Y is the outer diameter of the intermediate portion, and Z is the outer diameter of the small-diameter portion.

Fourth aspect to the present invention is a ceramic heater according to any one of the first to third aspect, satisfying the following relations:

$$0.4\ \text{mm} \leqq S$$

where S is the difference between the inner diameter of the main metal shell and the outer diameter of the electric conductive member.

Fifth aspect of the present invention is a ceramic heater according to any one of the first to fourth aspect, satisfying the following relation:

$$0.5\ \text{mm} \leqq (Y-Z).$$

Sixth aspect of the present invention is a ceramic heater according to any one of the first to fifth aspect, wherein the outer diameter of the rear end portion of the small-diameter potion of the ceramic sintered body is smaller than that of the front end portion of the small-diameter portion of the ceramic sintered body.

Seventh aspect of the present invention is a ceramic heater according to any one of the first to fifth aspect, wherein the outer diameter of the rear end portion of the small-diameter potion of the ceramic sintered body is larger than that of the front end portion of the small-diameter portion of the ceramic sintered body.

According to the first aspect of the invention, it is possible to place the first and the second electrodes on the different diameter surfaces of the ceramic sintered body. Therefore, it is not necessary to strictly control the position of the first and the second electrodes arranged on the material before sintering of the ceramic sintered body.

According to the second aspect of the invention, it is possible to make easier to control the shape of the second electrode.

According to the third aspect of the invention, the ceramic sintered body has the small-diameter portion at the rear end side whose diameter is smaller than the heating portion. Accordingly, the diameter difference can be provided sufficiently between the inner diameter of the main metal shell and the outer diameter of the electric conductive member so that the electrically insulating distance can be provided sufficiently between the main metal shell and the electric conductive member. Because the diameter of the heating portion is set to be $\phi 3.3$ mm or more and that of the small-diameter portion is set to be $\phi 2.5$ mm or more, there are no lowering of the durability due to the lack of the strength of the ceramic sintered body, thereby improving the durability of the ceramic heater.

According to the fourth aspect of the invention, a diameter difference is made to be not smaller than 0.4 mm so that even if eccentricity occurs between the main metal shell and the ceramic sintered body, the main metal shell can be kept electrically insulated from the lead coil or the electric conductive cap. On the other hand, it is preferable that the diameter difference is made to be not larger than 1.5 mm. Consequently, it is easy to secure the thickness of the screw portion of the main metal shell where the lead coil or the cap is positioned. Accordingly, the main metal shell can be prevented from the deformation due to the tightening torque when it is fitted to the fitting portion of an engine or the like.

According to the fifth aspect of the invention, it is possible to sufficiently provide the diameter difference between the inner diameter of the main metal shell and the outer diameter of the electric conductive member. Further, because it is possible to reduce the diameter of the main metal shell, the ceramic heater can be compact.

According to the sixth aspect of the invention, the outer diameter of the rear end side of the small-diameter portion of the ceramic sintered body is made to be smaller than the outer diameter of the front end side thereof. Accordingly, even if the outer diameter of the small-diameter portion is remarkably smaller than the inner diameter of the electric conductive member because of production error, the electric conductive member can be easily assembled to the outer periphery of the small-diameter portion of the ceramic sintered body by engaging the electric conductive member from the rear end of the small-diameter portion of the ceramic sintered body. The outer diameter of the small-diameter portion in this case is defined as the diameter size in the side of the top end portion of the small-diameter portion.

[0021]

According to the seventh aspect of the invention, the outer diameter of the rear end side of the small-diameter portion of the ceramic sintered body is made to be larger than the outer diameter of the front end side thereof. Accordingly, even if the outer diameter of the small-diameter portion is made larger than the inner diameter of the electric conductive member, the electric conductive member does not come off from the small-diameter portion and it is possible to obtain the conductivity between the electric conductive member and the electrode portion, thereby being possible to improve the durability of the ceramic heater. The outer diameter of the small-diameter portion in this case is defined as the diameter size in the side of the top end portion of the small-diameter portion.

PREFERRED EMBODIMENTS OF THE INVENTION

Preferred embodiments of the present invention will be described referring to embodiments shown in the accompanying drawings.

First Embodiment

Figure 1:
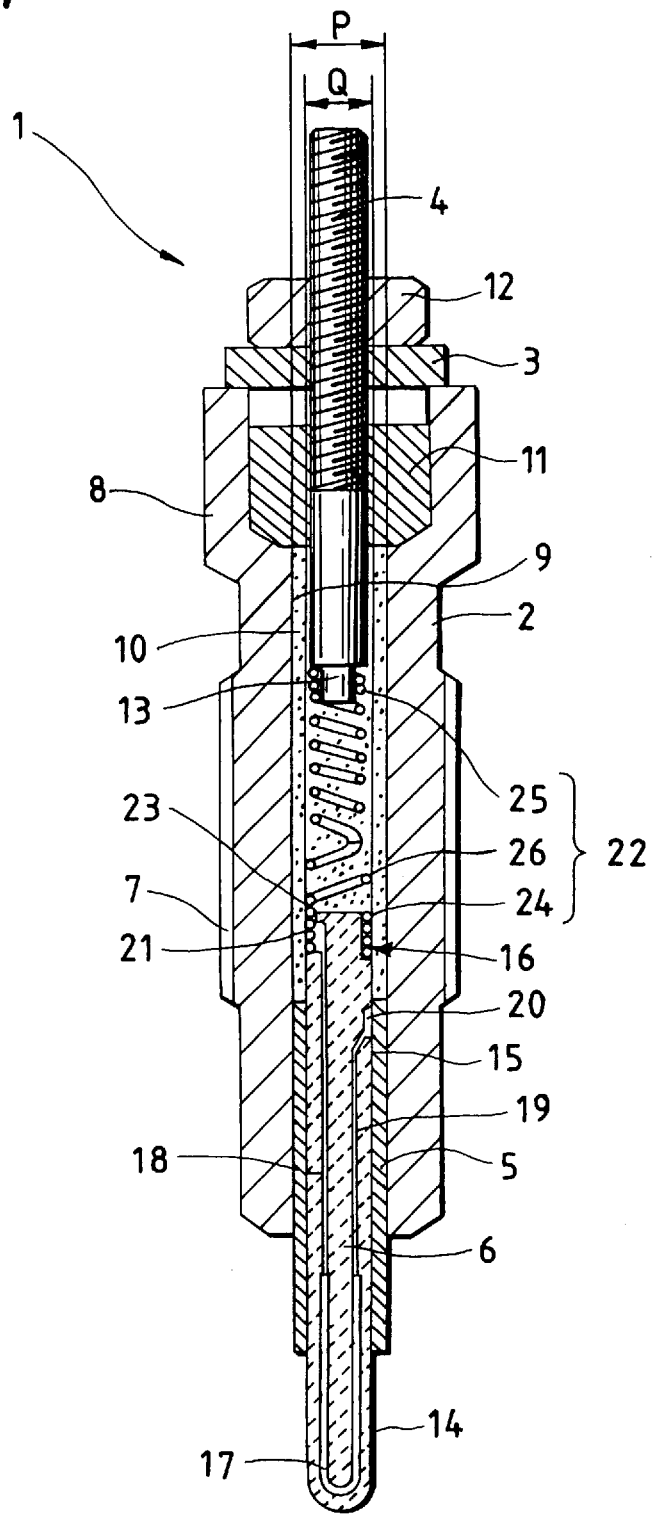
FIG. 1 is a sectional view showing the overall configuration of a ceramic glow plug (first embodiment)
Figure 2:
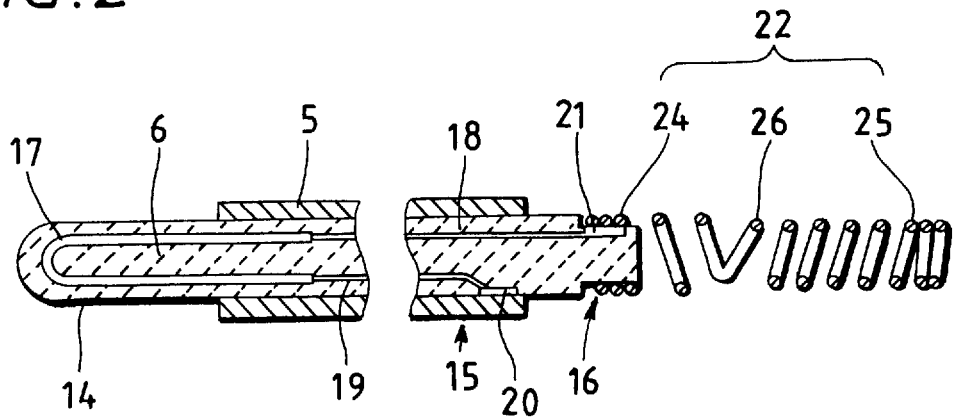
FIG. 2 is a sectional view showing the main configuration of the ceramic glow plug (first embodiment)
Figure 3:
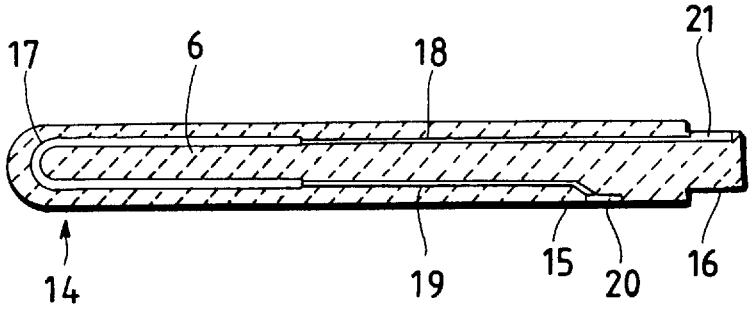
FIG. 3 is a sectional view showing the ceramic sintered body (first embodiment)

FIGS. 1 through 4 show a first embodiment according to the present invention. FIG. 1 shows the overall structure of a ceramic glow plug, FIG. 2 shows the main structure of the ceramic glow plug, and FIG. 3 shows a ceramic sintered body.

In this embodiment, the ceramic glow plug 1 comprises an metal shell 2, a center shaft 4 held and fixed through an annular electric insulator 3 in the rear end side of the metal shell 2, and a ceramic sintered body 6 held and fixed through a cylindrical metal outer pipe 5 in the front end side of the metal shell 2.

The metal shell 2 is equivalent to the main metal shell of the present invention. The metal shell 2 serves as a part for attaching the ceramic glow plug 1 to a cylinder head (not shown) of a Diesel engine having an antechamber such as a precombustion chamber, a vortex chamber, or the like, and also as a part for constituting a negative-pole-side terminal of the ceramic glow plug 1. An attachment screw portion 7 for screwing the metal shell 2 into the cylinder head of the Diesel engine and a hexagon headed bolt portion 8 to be engaged by a tool are formed in the outer periphery of the metal shell 2.

An inner hole 9 is formed axially through the inside of the metal shell 2. The inner hole 9 is formed so that the front end side thereof is narrowest and the rear end side thereof is widest. An opening portion in the rear end side of the inner hole 9 is sealed with a glass sealing material 11. Incidentally, the inner hole 9 may be filled with filler powder 10 of a molten glass material, or the like.

The center shaft 4 is a part constituting a positive-pole-side terminal of the ceramic glow plug 1. The front end side of the center shaft 4 is received in the metal shell 2 in a condition that the front end side of the center shaft 4 is separated from the inner circumferential surface of the metal shell 2 in the inner hole 9. The rear end side of the center shaft 4 is protruded from the opening portion of the rear end side of the metal shell 2 and held and fixed, through the electric insulator 3, to the opening portion of the rear end side of the metal shell 2 by means of a terminal nut 12. Further, the front end side of the center shaft 4 serves as an electrode connection portion 13 having a smaller outer diameter than the outer diameter of the other portion of the center shaft 4.

The metal outer pipe 5 is formed cylindrically from a metal excellent in heat resistance. The metal outer pipe 5 prevents intensive stress from acting on the ceramic sintered body 6 while the ceramic sintered body 6 is held in the front end side of the metal shell 2. At the same time, the metal outer pipe 5 serves also as an electric conductive member for electrically connecting the metal shell 2 to a heating element 17 embedded in the ceramic sintered body 6.

The ceramic sintered body 6 is a ceramic heater body which is produced, for example, from silicon nitride. The ceramic sintered body 6 is closely fitted into the inner hole 9 through the metal outer pipe 5 and held in the front end side of the metal shell 2. A heating portion 14 is provided in the front end side of the ceramic sintered body 6 so as to be protruded from the front end surface of the metal shell 2. Further, a negative-pole-side electrode lead-out portion 15 having the same outer diameter as the outer diameter of the heating portion 14 and a positive-pole-side electrode lead-out portion 16 having a smaller diameter than the outer diameter of the heating portion 14 are provided in the rear end side of the ceramic sintered body 6.

The U-shaped heating element 17 is embedded in the heating portion 14. A linear positive-pole-side lead 18 is led out from one end surface of the heating element 17, while a bent negative-pole-side lead 19 is led out from the opposite end surface of the heating element 17. When a current is supplied to the heating element 17, the surface temperature of the ceramic sintered body 6 rises to heat atomized fuel. The negative-pole-side electrode lead-out portion 15 has the same outer diameter as the outer diameter of the heating element 14. The negative-pole-side electrode lead-out portion 15 has an outer circumferential surface from which a negative-pole-side electrode portion 20 of the negative-pole-side lead 19 is exposed. The negative-pole-side electrode portion 20 is electrically connected to the metal shell 2 through the electrically conductive metal outer pipe 5.

The positive-pole-side electrode lead-out portion 16 is a portion equivalent to the small-diameter portion of the present invention. The positive-pole-side electrode lead-out portion 16 has a smaller outer diameter than the outer diameter of the negative-pole-side electrode lead-out portion 15. The positive-pole-side electrode lead-out portion 16 has an outer circumferential surface from which a positive-pole-side electrode portion 21 of the positive-pole-side lead 18 is exposed. The positive-pole-side electrode portion 21 is electrically connected to the center shaft 4 through a positive-pole-side lead coil 22. Incidentally, an R-shaped chamfered portion 23 may be formed in the rear end of the positive-pole-side electrode lead-out portion 16.

The positive-pole-side lead coil 22 is equivalent to the electric conductive member of the present invention. The positive-pole-side lead coil 22 has a front end side coil portion 24 wound on the outer periphery of the positive-pole-side electrode lead-out portion 16 and electrically connected to the positive-pole-side electrode portion 21 by bonding means such as brazing, or the like, a rear end side coil portion 25 wound on the outer periphery of the electrode connection portion 13 of the center shaft 4 and electrically connected to the electrode connection portion 13 by bonding means such as brazing, or the like, and a helical intermediate coil portion 26 for connecting the front end side coil portion 24 and the rear end side coil portion 25 to each other.

The effect of the present invention will be described in more detail.

In this embodiment, in order that the current-conduction durability, real-apparatus durability and ceramic strength can be secured, the clearance (electrically insulating distance) can be secured between the metal shell 2 and the positive-pole-side lead coil 22, and the attachment screw diameter of the attachment screw portion 7 of the metal shell 2 can be set to be not larger than M10, the sizes of the respective places are preferably defined as follows.

First, the wire diameter X of the positive-pole-side lead coil 22 is set to be in a range indicated by the following expression 1. Preferably, the wire diameter of the positive-pole-side lead coil 22 is set to be in a range of from ϕ0.4 mm to ϕ0.7 mm. It is preferable to use pure nickel or nickel alloy which has high heat resistivity and good conductivity as the material of the positive-pole-side lead coil 22.

[Expression 1]

$$\phi 0.2\ \text{mm} \leqq X \leqq \phi 0.7\ \text{mm}$$

Here, if the wire diameter of the positive-pole-side lead coil 22 is set to be smaller than ϕ0.2 mm, the resistance of the positive-pole-side lead coil 22 itself is made large and it become a resistance body. Accordingly, if the electric current is applied to function the glow plug, the positive-pole-side lead coil 22 is heated to thereby waste electric power. In addition, because the oxidation of the positive-pole-side lead coil 22 is progressed due to the heating, it lacks the durability. Further, since the waste electric power is consumed at this portion, a sufficient electric power can not be supplied to the heating element 17 and the temperature of the heating portion 14 of the ceramic sintered body 6 is not sufficiently increased. On the other hand, the wire diameter is set to be larger than ϕ0.7 mm, the durability is not actually changed, but it becomes difficult to secure the clearance (insulation distance) between the metal shell 2 and the positive-pole-side lead coil 22.

Results of the electricity transmission durability tests (Cyclic test: 3 min. ON-1 min. OFF at 11 V) in the case where the wire diameter of the positive-pole-side lead coil 22 made of pure nickel wire is varied are shown in Table 1. In the results, the lead coil having the durability in more than 10000 cycles is indicated by O, and the lead coil exhibiting resistance value increment or breaking in less than 10000 cycles is indicated by X.

TABLE 1

| Wire Diameter of Lead coil (mm) | Electricity Transmission Durability (cycles) |
|---|---|
| ϕ0.3 | X |
| ϕ0.4 | O |
| ϕ0.6 | O |

In view of these results, although the electricity transmission durability is extremely lowered in case of ϕ0.3 mm or less, there is no problem for actual use in case of ϕ0.4 mm or more.

Next, the outer diameter Y of the negative-pole-side electrode lead-out portion 15 of the ceramic sintered body 6 is set to be in a range indicated by the following expression 2. Preferably, the outer diameter of the negative-pole-side electrode lead-out portion 15 is set to be in a range of from ϕ3.5 mm to ϕ3.6 mm.

[Expression 2]

$$\phi 3.3\ \text{mm} \leqq Y \leqq \phi 5.0\ \text{mm}$$

If the outer diameter of the negative-pole-side electrode lead-out portion 15 of the ceramic sintered body 6 is selected to be smaller than the value described above, it is necessary to squash the heating element 17 into the U shape in terms of embedding of the heating element 17 in the U shape. In such a case, there is a risk of cracking of the heating element 17 per se or approaching of the opposite end portions of the heating element 17 to make it impossible to keep the electrically insulating distance between the opposite end portions of the heating element 17. Accordingly, in the case where the electrically insulating distance between the opposite end portions of the heating element 17 is to be kept not smaller than 1 mm and the mechanical strength of the negative-pole-side electrode lead-out portion 15 is to be made to bear vibration at the time of use of the negative-pole-side electrode lead-out portion 15 actually attached to the engine, it is undesirable to make the outer diameter of the heating portion 14 smaller than ϕ 3.3 mm when employed in the actual apparatus, even if it tries to reduce the outer diameter of the heating portion 14 as much as possible. On the other hand, if it is larger than ϕ5.0 mm, because the thickness of the metal shell 2 should be thin, there may arise a problem concerning to the strength.

Table 2 shows the results of the test in which the ceramic heater 1 is actually mounted to an engine in case of changing the outer diameter of the ceramic sintered body 6 while the top of the heating portion 14 of the ceramic sintered body 6 is projected 9 mm from the top end surface of the metal outer pipe 5. In this test, a straight 4-valve 1800 cc engine was used, and the generation of cracks were observed when abnormal combustion such as knocking were forcibly generated.

TABLE 2

| Diameter of negative-pole-side electrode lead-out portion (mm) | Crack test |
|---|---|
| ϕ3.0 | Crack generated |
| ϕ3.3 | No Crack |
| ϕ3.5 | No Crack |

In view of these results, it was confirmed that if the outer diameter of the ceramic sintered body 6 is set to be more than ϕ3.3 mm, cracks does not generated and the condition is good.

Next, the outer diameter Z of the positive-pole-side electrode lead-out portion 16 of the ceramic sintered body 6 is set to be in a range indicated by the following expression 3. Preferably, the outer diameter of the positive-pole-side electrode lead-out portion 16 is set to be in a range of from ϕ2.5 mm to ϕ3.0 mm.

[Expression 3]

$$\phi 2.5\ \text{mm} \leqq Z \leqq \phi 4.5\ \text{mm}$$

The positive-pole-side electrode lead-out portion 16 of the ceramic sintered body 6 is designed so that the rear end side of the ceramic sintered body 6 having the same outer diameter as the outer diameter of the negative-pole-side electrode lead-out portion 15 is polished to be thinned. The method of leading out the positive-pole-side lead 18 of the heating element 17 straight to the positive-pole-side electrode portion 21 is more excellent in prevention of breaking in the middle than the method of bending the positive-pole-side lead 18 on the way to make the positive-pole-side lead 18 pass the center side. Further, as described above, the electrically insulating distance between the opposite end portions of the heating element 17 must be set to be not smaller than 1 mm. Accordingly, taking account of the rod diameter of the heating element and the rod diameters of the positive-pole-side and negative-pole-side leads 18 and 19, the outer diameter of the positive-pole-side electrode lead-out portion 16 cannot be set to be not larger than ϕ2.0 mm even if the outer diameter of the positive-pole-side electrode lead-out portion 16 is set to be as small as possible. On the other hand, if it is set to be more than ϕ4.5 mm, it is difficult to sufficiently secure the insulation distance between the metal shell 2 and the positive-pole-side lead coil 22.

Table 3 shows the results of the shock resistivity test defined in JIS B8031 in the case where the diameter of the positive-pole-side electrode lead-out portion 16 is set to be ϕ2.0 mm and ϕ2.5 mm. Incidentally, this test was carried out in the vibration amplitude of 5 mm.

TABLE 3

| Diameter of positive-pole-side electrode lead-out portion (mm) | Shock test |
|---|---|
| ϕ2.0 | Crack generated |
| ϕ2.5 | No crack |

In view of the results of the test, it was understood that the outer diameter of the positive-pole-side electrode lead-out portion 16 is needed to be ϕ2.5 mm or more.

Next, the inner diameter V of the metal outer pipe 5 fitted to the negative-pole-side electrode lead-out portion 15 and between the outer periphery of the negative-pole-side electrode lead-out portion 15 and the inner periphery of the metal shell 2 is set to be ϕ0.2 mm-larger than the outer diameter (specifically, the outer diameter Y of the heating portion 14) of the ceramic sintered body 6.

Here, in order to secure the strength and heat resistance of the metal outer pipe 5 to thereby protect the ceramic sintered body 6, the metal outer pipe 5 is produced from a heat-resisting metal material selected from stainless steel such as SUS430, or the like, nickel alloy such as Inconel 601, or the like, etc. Further, the plate thickness of the metal outer pipe 5 may be set to be in a range of, for example, from 0.4 mm to 1.5 mm.

Next, the inner diameter P of the metal shell 2 is set to be ϕ0.1 mm-larger than the outer diameter of the metal outer pipe 5. Incidentally, the metal shell 2 is produced from carbon steel such as S40C, or the like.

Next, the coil inner diameter of the positive-pole-side lead coil 22 before fitting it to the ceramic sintered body 6 is set to be ϕ0.1 mm-smaller than the outer diameter of the positive-pole-side electrode lead-out portion 16 of the ceramic sintered body 6. Because the positive-pole-side lead coil 22 has a spring ability, the brazing operation after fitting to the positive-pole-side electrode lead-out portion 16 becomes easy.

Next, the wire diameter of the lead coil used in the positive-pole-side lead coil 22 after fitting the positive-pole-side lead coil 22 to the ceramic sintered body 6 is set to be ϕ0.5 mm. Accordingly, the outer diameter Q of the positive-pole-side lead coil 22 becomes ϕ1.0 mm-larger than the outer diameter of the positive-pole-side electrode lead-out portion 16 of the ceramic sintered body 6.

Next, the diameter difference S (=P−Q) between the inner diameter of the metal shell 2 and the coil outer diameter of the positive-pole-side lead coil 22 is selected to be in a range represented by the following expression 4. Preferably, the clearance is set to be in a range of from 0.8 mm to 1.5 mm.

[Expression 4]

$$0.4\ \text{mm} \leqq S \leqq 1.5\ \text{mm}$$

Here, when the diameter difference between the inner diameter of the metal shell 2 and the coil outer diameter of the positive-pole-side lead coil 22 is set to be at least not smaller than 0.4 mm, the electric insulation between the positive-pole-side lead coil 22 and the metal shell 2 can be kept even in the case where eccentricity occurs in the metal shell 2 and the ceramic sintered body 6. Preferably, as described above, the diameter difference between the inner diameter of the metal shell 2 and the coil outer diameter of the positive-pole-side lead coil 22 is selected to be not smaller than 0.8 mm.

The difference between the inner diameter of the metal shell 2 at the positive-pole-side electrode lead-out portion 16 and the coil outer diameter of the positive-pole side lead coil 22 was set to 0,2 mm and 0.4 mm. One hundred of respective samples were used to assemble the spark plug. The ratio of the occurrence of short circuiting was examined, which is shown in Table 4.

TABLE 4

| Diameter difference (mm) | Occurrence ratio of short-circuiting (%) |
|---|---|
| 0.2 | 60 |
| 0.4 | 0 |

In view of these results, if the diameter difference is 0.4 mm or more, even if the metal shell 2 is eccentric to the ceramic sintered body 6, it is understood that the electric insulation between the positive-pole-side lead coil 22 and the metal shell 2 can be secured.

As described above, the ceramic glow plug 1 is configured such that the outer diameter of the positive-pole-side electrode lead-out portion 16 provided in the rear end side of the ceramic sintered body 6 is set to be smaller by about ϕ0.5 mm than the outer diameter of the negative-pole-side electrode lead-out portion 15, the wire diameter of the positive-pole-side lead coil 22 is kept ϕ0.5 mm, and the outer diameter of the metal outer pipe 5 is set to be ϕ4.7 mm, whereby a diameter difference, for example, of 0.7 mm to 1.0 mm can be secured between the inner diameter of the metal shell 2 and the coil outer diameter of the positive-pole-side lead coil 22 even if no relief portion is provided in the inner hole 9 of the metal shell 2. When the attachment crew is set to be M8, the outer diameter of the negative-pole-side electrode lead-out portion 15 of the ceramic sintered body 6 is set to be ϕ3.5 mm and the outer diameter of the positive-pole-side electrode lead-out portion 16 is set to ϕ3.0 mm. The outer diameter of the positive-pole-side lead coil 22 is ϕ4.0 mm so that the wire diameter of the positive-pole-side lead coil is ϕ0.5 mm. Then, the inner diameter of the metal shell 2 is set to be ϕ4.8 mm taking account of the strength of the metal shell 2. Accordingly, it is possible to secure the diameter difference of, for example, 0.8 mm between the inner diameter of the metal shell 2 and the coil outer diameter of the positive-pole-side lead coil 22.

Accordingly, because the sufficient electrically insulating distance can be secured between the metal shell 2 serving as a negative-pole-side terminal and the positive-pole-side lead coil 22, short-circuiting can be prevented from occurring between the metal shell 2 and the positive-pole-side lead coil 22. Further, because it is not necessary to provide any relief portion in the inner circumferential side of the metal shell 2, current-conduction durability, real-apparatus durability and ceramic strength can be secured even in the case where the attachment screw diameter of the attachment screw portion 7 of the metal shell 2 is selected to be not larger than M10 (for example, M8). Accordingly, the ceramic glow plug 1 in which the outer diameter of the negative-pole-side electrode lead-out portion 15 is not smaller than ϕ3.3 mm and the attachment screw diameter is not larger than M10 can be produced.

Furthermore, if the outer diameter of the positive-pole-side electrode lead-out portion 16 of the ceramic sintered body 6 is selected to be smaller than ϕ2.5 mm, the strength of the ceramic sintered body 6 is weakened so that sufficient durability cannot be secured. In this embodiment, the outer diameter of the positive-pole-side electrode lead-out portion 16 is set to be not smaller than ϕ2.5 mm so that the aforementioned disadvantage can be avoided. Further, for production of a ceramic glow plug 1 in which the attachment screw diameter of the metal shell 2 is larger than M10, the outer diameter of the positive-pole-side electrode lead-out portion 16 can be made to be ϕ3.0 mm or larger. Accordingly, the strength of the ceramic sintered body 6 is improved, so that sufficient durability can be secured. Further, the sufficient diameter difference can be secured between the inner diameter of the metal shell 2 and the coil outer diameter of the positive-pole-side lead coil 22.

Figure 4:
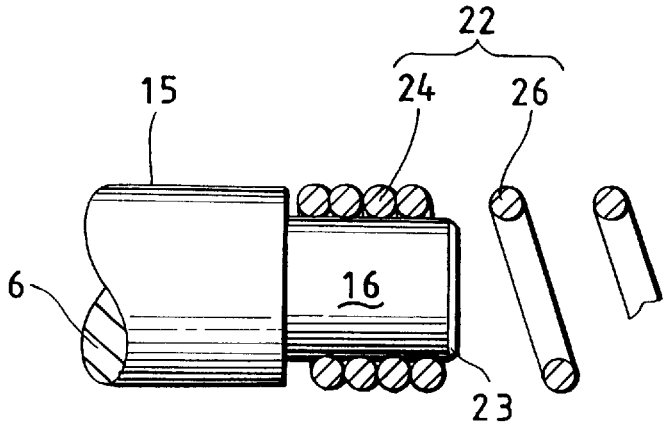
FIG. 4 is an explanatory view showing the positive-pole-side electrode lead-out portion and the positive-pole-side lead coil (first embodiment)

Further, as shown in FIG. 4, the R-shaped chamfered portion 23 is formed at the rear end of the positive-pole-side electrode lead-out portion 16 of the ceramic sintered body 6. Accordingly, even in the case where the outer diameter of the positive-pole-side electrode lead-out portion 16 is larger than the coil inner diameter of the positive-pole-side lead coil 22 because of production error, the positive-pole-side lead coil 22 is fitted onto the positive-pole-side electrode lead-out portion 16 from the rear end of the positive-pole-side electrode lead-out portion 16 so that the positive-pole-side lead coil 22 can be assembled with the ceramic sintered body 6 easily.

Second Embodiment

Figure 5:
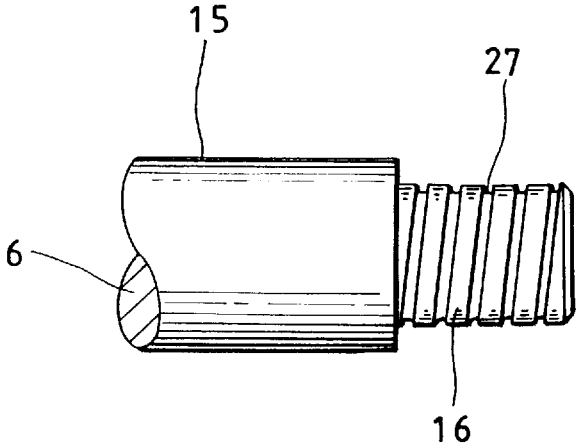
FIG. 5 is a side view showing the positive-pole-side electrode lead-out portion (second embodiment)

FIG. 5 shows a second embodiment according to the present invention. FIG. 5 is a view showing a positive-pole-side electrode lead-out portion of a ceramic sintered body in a ceramic glow plug.

In this embodiment, a helical groove 27 is provided in the positive-pole-side electrode lead-out portion 16 of the ceramic sintered body 6 so as to be along the coil shape of the positive-pole-side lead coil 22. Accordingly, when the positive-pole-side lead coil 22 is to be wound on the outer periphery of the positive-pole-side electrode lead-out portion 16 of the ceramic sintered body 6, the positive-pole-side lead coil 22 is thrusted helically along the helical groove 27. Consequently, the positive-pole-side lead coil 22 can be wound on the outer periphery of the positive-pole-side electrode lead-out portion 16 of the ceramic sintered body 6 easily.

Furthermore, the positive-pole-side lead coil 22 is fixed onto the outer periphery of the positive-pole-side electrode lead-out portion 16 in the state in which the positive-pole-side lead coil 22 is fitted onto the groove peak of the helical groove 27 of the positive-pole-side electrode lead-out portion 16. In addition, the front end side coil portion 24 of the positive-pole-side lead coil 22 is brazed or soldered to the positive-pole-side electrode portion 21. Accordingly, stable current conduction can be obtained between the positive-pole-side lead coil 22 and the positive-pole-side electrode portion 21, so that the durability of the ceramic glow plug 1 can be improved.

Third Embodiment

Figure 6:
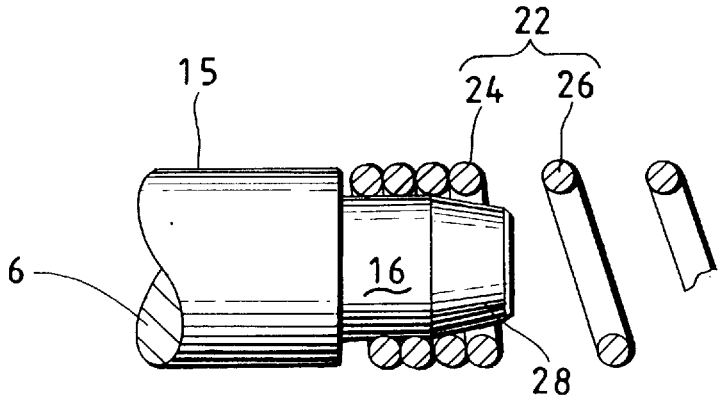
FIG. 6 is an explanatory view showing the positive-pole-side electrode lead-out portion and the positive-pole-side lead coil (third embodiment)

FIG. 6 shows a third embodiment according to the present invention. FIG. 6 is a view showing the positive-pole-side electrode lead-out portion of the ceramic sintered body and the positive-pole-side lead coil in the ceramic glow plug.

In this embodiment, the ceramic glow plug has a taper portion 28 in which the outer diameter of the positive-pole-side electrode lead-out portion 16 decreases as the position approaches the rear end of the positive-pole-side electrode lead-out portion 16 of the ceramic sintered body 6 from the middle of the positive-pole-side electrode lead-out portion 16. Accordingly, even in the case where the outer diameter of the positive-pole-side electrode lead-out portion 16 is larger than the coil inner diameter of the positive-pole-side lead coil 22 because of production error, the positive-pole-side lead coil 22 is fitted onto the positive-pole-side electrode lead-out portion 16 from the rear end of the electrode lead-out portion 16 so that the positive-pole-side lead coil 22 can be assembled with the ceramic sintered body 6 easily.

Fourth Embodiment

Figure 7:
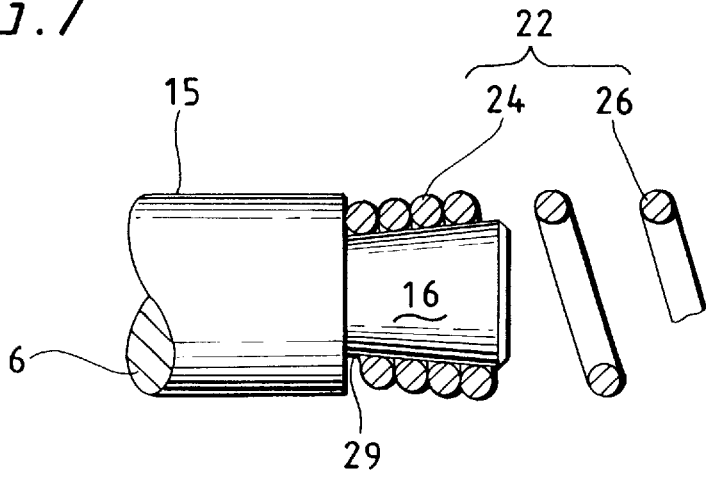
FIG. 7 is an explanatory view showing the positive-pole-side electrode lead-out portion and the positive-pole-side lead coil (fourth embodiment)
Figure 8:
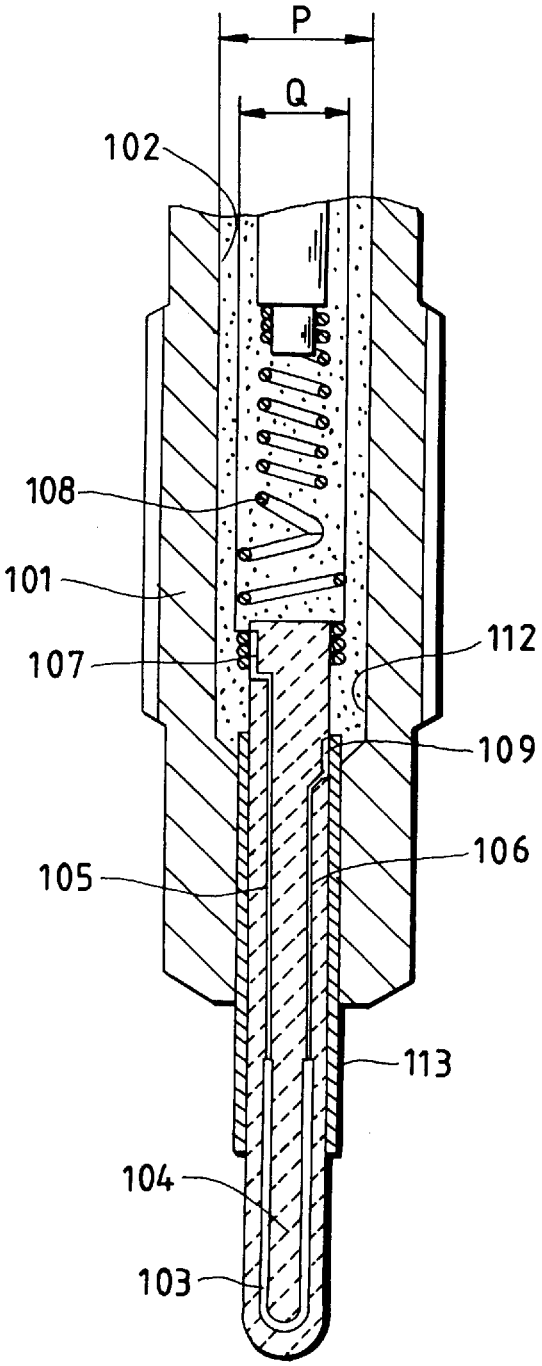
FIG. 8 (PRIOR ART)
FIG. 8 is a sectional view showing main part of a ceramic glow plug (first conventional art)
Figure 9:
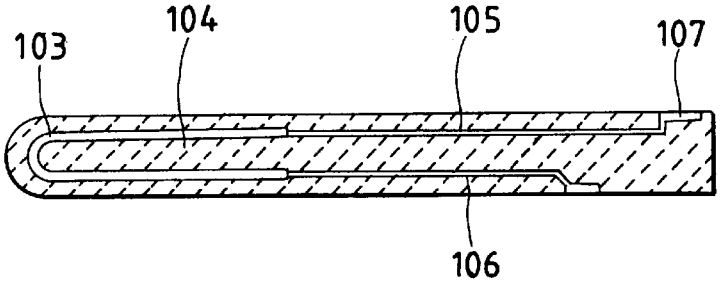
FIG. 9 (PRIOR ART)
FIG. 9 is a sectional view showing the ceramic sintered body (first conventional art)
Figure 10:
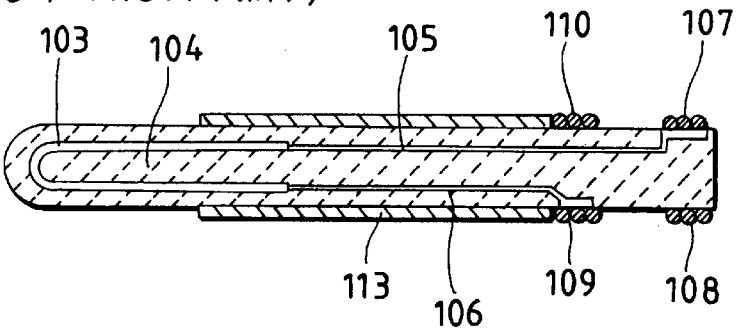
FIG. 10 (PRIOR ART)
FIG. 10 is a sectional view showing a ceramic sintered body and positive-pole-side and negative-pole-side lead coils (second conventional art)
Figure 11:
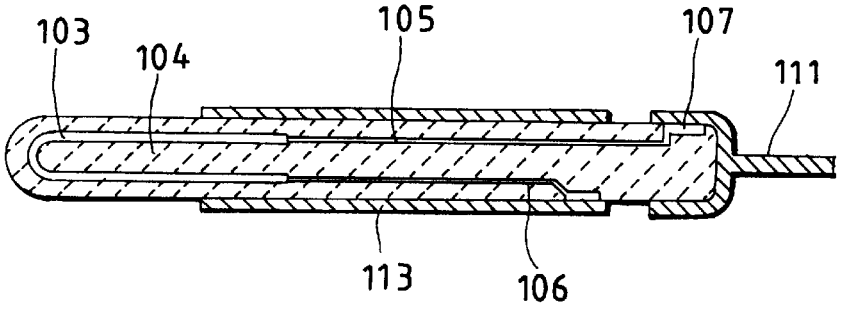
FIG. 11 (PRIOR ART)
FIG. 11 is a sectional view showing the ceramic sintered body and a cap (third conventional art).

FIG. 7 shows a fourth embodiment according to the present invention. FIG. 7 is a view showing the positive-pole-side electrode lead-out portion of the ceramic sintered body and the positive-pole-side lead coil in the ceramic glow plug.

In this embodiment, the ceramic glow plug has a reverse taper portion 29 in which the outer diameter of the positive-pole-side electrode lead-out portion 16 increases as the position approaches the rear end of the positive-pole-side electrode lead-out portion 16 of the ceramic sintered body 6.

Accordingly, even in the case where the outer diameter of the positive-pole-side electrode lead-out portion 16 is smaller than the coil inner diameter of the positive-pole-side lead coil 22 because of production error, the positive-pole-side lead coil 22 is prevented from coming off from the positive-pole-side electrode lead-out portion 16. Accordingly, stable current conduction can be obtained between the positive-pole-side lead coil 22 and the positive-pole-side electrode portion 21, so that the durability of the ceramic glow plug 1 can be improved.

Although the aforementioned embodiments have been described about the case where the present invention is applied to a ceramic glow plug 1, the present invention may be applied to a sheath type glow plug, a heat flange or a ceramic heater such as a burner heater, an air heater, etc.

Further, the outer diameter of the positive-pole-side electrode lead-out portion 16 of the ceramic sintered body 6 may be formed so as to decrease as the position approaches the rear end from the front end of the positive-pole-side electrode lead-out portion 16. Further, the outer diameter of the negative-pole-side electrode lead-out portion 15 may be selected to be smaller than the outer diameter of the negative-pole-side electrode lead-out portion 15 so that the negative-pole-side lead coil is wound on the outer periphery of the negative-pole-side electrode lead-out portion 15. In addition, a cap may be used as the electric conductive member.

What is claimed is:

1. A ceramic heater comprising:

a main metal shell having an inner hole in an axial direction;

a ceramic sintered body in which an intermediate portion is fitted into the inner hole and a front end portion is protruded out from the main metal shell, the ceramic sintered body having a heating portion provided with a heating element embedded in the front end side, a small-diameter portion provided in the rear end side and having a smaller outer diameter than the outer diameter of the heating portion, a first electrode electrically connected to one end portion of the heating portion and bent to expose to the outer periphery itself, and a second electrode electrically connected to the other end portion of the heating portion and bent to expose to the outer periphery of the small-diameter portion, the bending of the second electrode being smaller than that of the first electrode; and an electric conductive portion electrically connected to the second electrode exposed to the outer periphery of the small-diameter portion of the ceramic sintered body.

2. A ceramic heater according to claim 1, wherein the second electrode is substantially linear.

3. A ceramic heater according to claim 1, satisfying relations of:

$$\phi 3.3\ \text{mm} \leqq Y$$

$$\phi 2.5\ \text{mm} \leqq Z$$

where Y is an outer diameter of the intermediate portion of the sintered ceramic body, and Z is an outer diameter of the small-diameter portion of the sintered ceramic body.

4. A ceramic heater according to claim 1, satisfying a relation of:

$$0.4\ \text{mm} \leqq S$$

where S is a difference between an inner diameter of the main metal shell and an outer diameter of the electric conductive member.

5. A ceramic heater according to claim 1, satisfying a relation of:

$$0.5\ \text{mm} \leqq (Y-Z)$$

where Y is an outer diameter of the intermediate portion of the sintered ceramic body, and Z is an outer diameter of the small-diameter portion of the sintered ceramic body.

6. A ceramic heater according to claim 1, wherein an outer diameter of the rear end portion of the small-diameter potion of the ceramic sintered body is smaller than that of the front end portion of the small-diameter portion of the ceramic sintered body.

7. A ceramic heater according to claim 1, wherein an outer diameter of the rear end portion of the small-diameter portion of the ceramic sintered body is larger than that of the front end portion of the small-diameter portion of the ceramic sintered body.

8. A ceramic heater according to claim 3, satisfying a relation of:

$$0.4\ \text{mm} \leqq S$$

where S is a difference between an inner diameter of the main metal shell and an outer diameter of the electric conductive member.

9. A ceramic heater according to claim 3, satisfying a relation of:

$$0.5\ \text{mm} \leqq (Y-Z).$$

10. A ceramic heater according to claim 1, wherein an R-shaped chamfered portion is formed at the rear end of a positive-pole-side electrode lead-out portion of the ceramic sintered body.

11. A ceramic heater according to claim 1, wherein a helical groove is provided in a positive-pole-side electrode lead-out portion of the ceramic sintered body.

12. A glow plug using the ceramic heater according to any one of claims 1 to 11.

* * * * *